US005672065A

United States Patent [19]

Womack

[11] Patent Number: 5,672,065

[45] Date of Patent: Sep. 30, 1997

[54] GROUND ROD CONNECTING DEVICE

[76] Inventor: Robert R. Womack, 15864 Ridge Rd., Sutter Creek, Calif. 95685

[21] Appl. No.: 635,585

[22] Filed: Apr. 22, 1996

[51] Int. Cl.[6] ..... H01R 4/66

[52] U.S. Cl. ..... 439/100; 174/94 R; 403/314

[58] Field of Search ..... 439/100, 486, 439/487, 863; 174/84 C, 93, 94 R, 40 CC; 403/314, 304

[56] References Cited

U.S. PATENT DOCUMENTS 1,975,683 10/1934 Childs ..... 439/863
2,107,835 2/1938 Pierce ..... 439/100
2,883,220 4/1959 Johnson ..... 174/84 C
3,200,190 8/1965 Forney ..... 174/84 C
3,231,964 2/1966 Bennett ..... 174/84 C

*Primary Examiner*—Neil Abrams
*Assistant Examiner*—T. C. Patel
*Attorney, Agent, or Firm*—Bielen, Peterson & Lampe

[57] ABSTRACT

A device for connecting a ground rod to an electrical conductor utilizing a sleeve having a pair of open chambers that form a tapered configuration. The open chambers accommodate the ground rod and an electrical conductor and permit the same to engage one another when the ground rod and electrical conductor are forced completely into their respective chambers. The open chambers face on another and allow engagement of the ground rod with the electrical conductor inside the sleeve.

5 Claims, 2 Drawing Sheets

GROUND ROD CONNECTING DEVICE

BACKGROUND OF THE INVENTION

The present invention relates to a novel and useful device for connecting a ground rod to an electrical conductor.

Electrical systems found in edifices and other structures are required to be grounded by the utilization of a ground rod that is forced into the ground by an impact hammer. A ground wire or conductor, leading from the edifice much then be connected to the ground rod in order to complete the electrical connection.

In the past, electrical ground wires from the edifices have been connected to the ground rod using a clamp, which is attached by the use of threaded screws or bolts. Unfortunately, the connecting clamps in the prior art tend to loosen or break. The latter tend to occur under minimal force. Loosening of the ground rod and ground wire connection often causes fluctuation in the power output to the edifice. Typically, the lighting within the edifice tend to flicker in this regard.

A device for connecting a ground rod to an electrical ground conductor which is reliable and simple to employ, would be a notable advance in the construction fields.

SUMMARY OF THE INVENTION

In accordance with the present invention, a novel and useful device for connecting a ground rod to an electrical ground conductor is herein provided.

The device of the present invention utilizes a sleeve having a first open chamber for accommodating the ground rod. A second open chamber adjacent the first open chamber is employed to accommodate an electrical conductor which is usually smaller in size than the ground rod. The first and second open chambers each include a mouth which face one another within the sleeve. The sum of the widths or transverse dimensions of the first and second open chambers may vary along a dimension of the chambers to form an overall taper. The sleeve further includes an impact surface to allow the user to apply the blow of a hammer on the sleeve. The impact surface may take the form of a rim or plateau on an end of the sleeve. The sleeve is generally constructed of a material possessing a flexibility or malleability which is greater than the material utilized for the ground rod and electrical conductor. Also, the electrical conductor may be of a softer material than the ground rod, which is typically more rigid.

Contacting means is also found in the present invention for urging the ground rod into engagement with the electrical conductor. Such engagement is accomplished by the application of a force on the impact surface of the sleeve. The actual contact between the ground rod and the electrical conductor takes place through the mouths of the first and second open chambers. In addition, the tapering of the first and second open chambers, or the tapering of one of the first and second open chambers, creates a friction fit between the ground rod and the electrical conductor when both are forced completely into their respective chambers and into contact with the walls, thereof. The engagement of the electrical conductor with the ground rod may also entail a deformation of either the electrical conductor or the ground rod, and a deformation of the sleeve.

The device of the present invention may also be fitted with a sheath that at least partially extends over the sleeve. The sheath may further possess fastening means for holding the same to the sleeve. Such fastening means may take the form of a threaded screw, a rivet, a mastic, a simple friction fit, and the like. The sheath may be employed as a connector for a conduit which is used to enclose the electrical conductor. Thus, the device of the present invention may be employed in residential or commercial areas.

It may be apparent that a novel and useful device for connecting a ground rod to an electrical conductor, such as a ground wire, has been described.

It is therefore an object of the present invention to provide a device for connecting a ground rod to an electrical conductor that obviates the need for a clamping mechanism that tends to loosen and break over time.

Another object of the present invention is to provide a device for connecting a ground rod to an electrical conductor that is simple to install and requires a lesser labor cost to achieve the same.

Another object of the present invention is to provide a device for connecting a ground rod to an electrical conductor which connects a ground rod to an electrical conductor by way of a friction fit which causes deformation of the elements connected to one another and deformation of a sleeve, to allow conformation of the sleeve to the ground rod and electrical conductor.

Yet another object of the present invention is to provide a device for connecting a ground rod to an electrical conductor which is capable of accommodating ground rods of various sizes and shapes and is applicable to residential or commercial areas.

The invention possesses other objects and advantages especially as concerns particular characteristics and features thereof which will become apparent as the specification continues.

Figure 1:
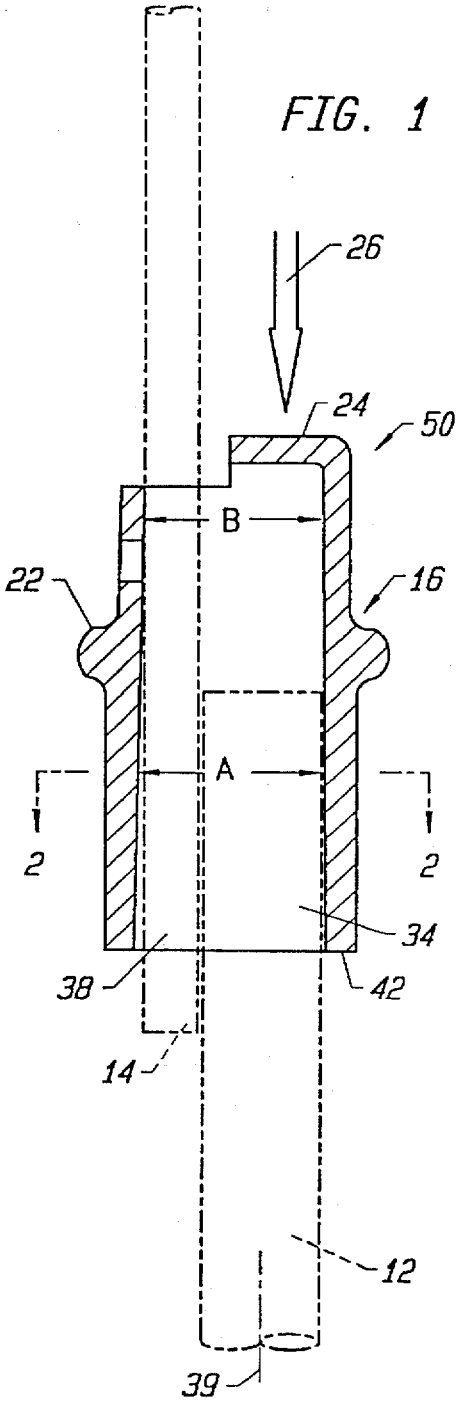
FIG. 1 is a sectional view of the device of the present invention employed with a ground rod and an electrical conductor wire prior to application of the impact force of the connecting means of the present invention.

For a better understanding of the invention, references made to the following Detailed Description of the Preferred Embodiments thereof which should be taken in conjunction with the prior described drawings.

DETAILED DESCRIPTION OF TO PREFERRED EMBODIMENTS

Various aspects of the present invention will evolve from the following Detailed Description of the Preferred Embodiments which should be taken in conjunction with the hereinbefore described drawings.

The invention as a whole is a depicted in the drawings by reference character 10. The device 10 is employed for connecting a ground rod 12 to an electrical conductor 14 which may be a ground wire leading from a edifice or structure. Ground rod 12 is normally formed of a harder, more rigid material such as steel plated or clad with copper or other, electrically conducting metals. Ground wire 14 is typically aluminum or copper. Ground rod 12 normally is driven partially into the ground, such that a portion of the rod 12 extends from the ground surface for connection to ground wire 14.

Figure 7:
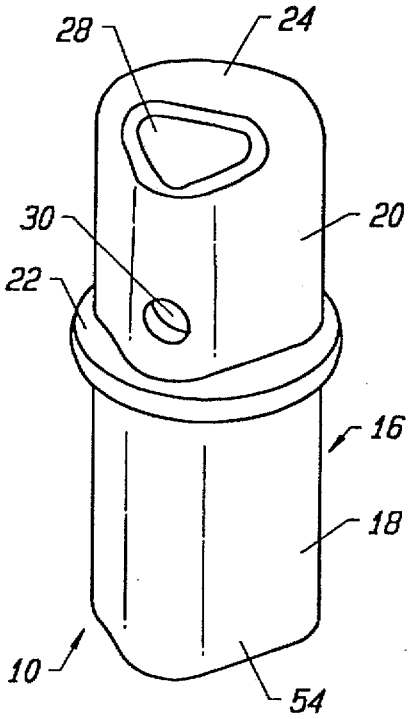
FIG. 7 is a top right perspective view of the device of the present invention prior to electrical connection of a ground rod and an electrical conductor.

Device 10 includes as one of its elements, a sleeve 16, which may be formed of a material such as brass, brass and pewter, bronze and the like. In certain cases, sleeve 16 may be constructed of a material that is more flexible than the material used for ground wire 14 or ground rod 12. With reference to FIG. 7, it may be seen that device 10 includes a lower portion 18 and an upper portion 20. Shoulder 22 separates lower portion 18 from upper portion 20. Impact surface 24 permits the use of a hammer or similar implement to apply a force thereupon, represented by arrow 26 of FIG. 1. Opening 28 in upper portion 20 permits the passage of conductor 14 to the interior of device 10. Opening 30 allows the passage of a fastener, such as set screw 32 of FIG. 6, which will be described in greater detail hereinafter.

Figure 3:
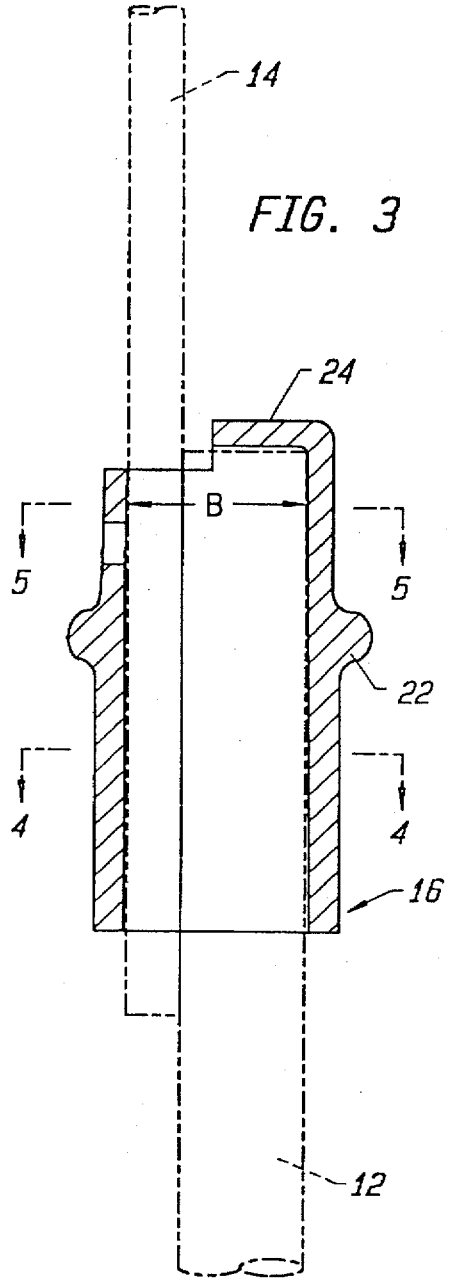
FIG. 3 is a sectional view of the device of the present invention in which the connecting means has forced the ground wire into contact with the electrical conductor.
Figure 2:
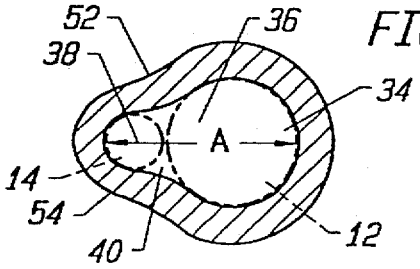
FIG. 2 is a sectional view taken along line 2—2 of FIG. 1.
Figure 5:
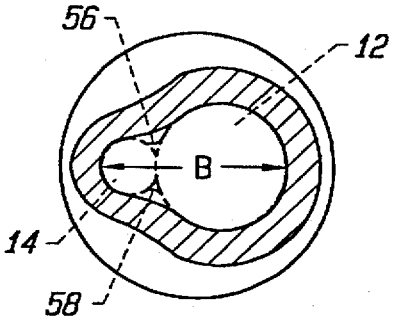
FIG. 5 is a sectional view taken along line 5—5 of FIG. 3.

Turning to FIG. 2, it may be observed that sleeve 16 is formed with a first open chamber 34 having a mouth 36. Adjacent first open chamber 34 is a second open chamber 38 which is smaller in size and also includes mouth 40. First and second open chambers 34 and 38 face each other to allow communication between first and second open chambers 34 and 38, respectively. Referring now to FIG. 1, it may be observed that a distance "A" represents the combined width or transverse dimensions of first and second open chambers 34 and 38. With reference to FIGS. 1, 3 and 5, it may be observed that a second distance "B" illustrates the combined transverse width of chambers 34 and 38 at a place near impact surface 24. In other words, the combined chambers 34 and 38 have an overall width that tapers from a large size, at the base 42 of sleeve 16, to a narrower size, near the impact surface 24 of sleeve 16, orthogonally to axis 39. In other words, ground rod 16 depicted in FIG. 1, friction fits against ground wire 14 within chambers 34 and 38, respectively. This occurs since the tapered chambers 34 and 38 force ground wire 14 against sleeve 16 when ground rod 12 is advanced completely into chamber 34, FIG. 3. Although chamber 34 is depicted as not being tapered and chamber 38 is depicted as being tapered in the drawings, such arrangement can be reversed. Also both chambers 34 and 38 may possess a taper in an equivalent structure.

Figure 6:
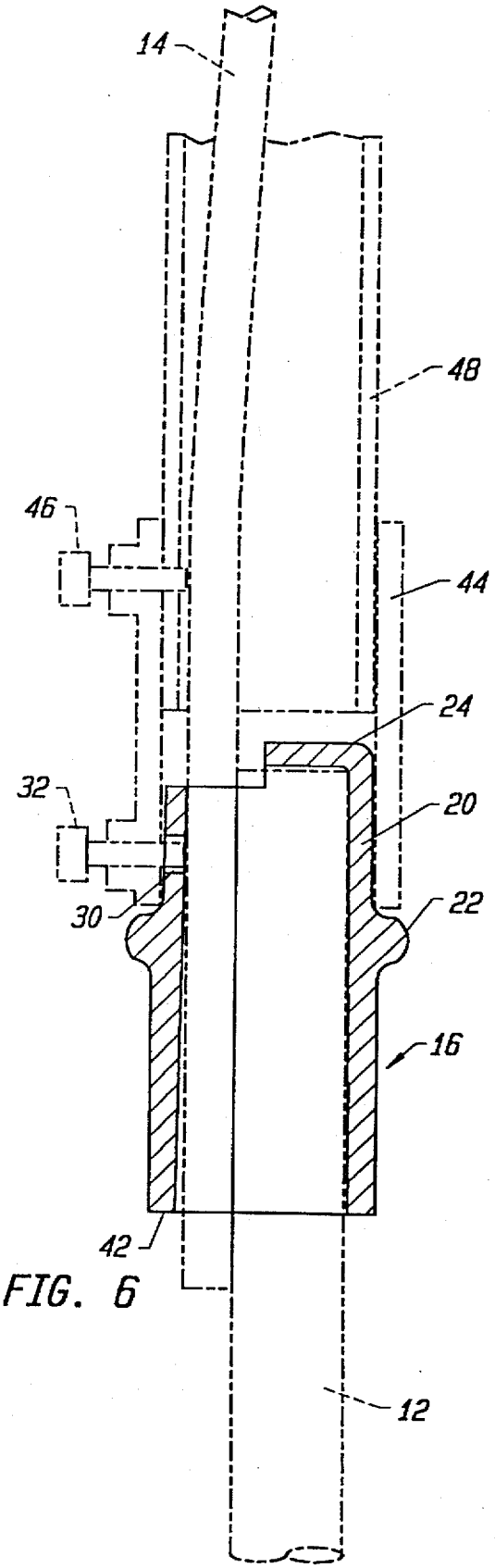
FIG. 6 is a sectional view of the device of the present invention in which the ground wire and electrical conductor forced into engagement by contacting means and where a sheath has been installed.

Turning to FIG. 6, it may be observed that a sheath 44 has been placed over top portion 20 of sleeve 16. Sheath 44 essentially rests on shoulder 22 in this position. Fastener 46 holds sheath 44 to ground wire 14 through opening 30. Protective conduit 48, used in a commercial installation, extends over ground wire 14 and sits within sheath 44. In this aspect of the present invention, sheath 44 is serving as a connector for conduit 48. Fastener 46 passes through sheath 44 and engages conduit 48 to hold the same in place.

Figure 4:
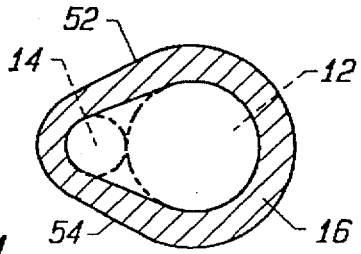
FIG. 4 is a sectional view taken along line 4—4 of FIG. 3.

In operation, the user leads ground rod 12 partially into chamber 34 of sleeve 16 and ground wire 14 into and through second chamber 38 thereof. Such positioning is depicted in FIG. 1 of the drawings. At this point, ground rod 16 has already been placed within the ground by an impact hammer or other device. The user then employs a hammer or other tool to impart a force to sleeve 16, arrow 26 on impact surface 24. Such contacting means 50 causes ground rod 12 to travel completely into chamber 34, FIG. 3, and to snugly engage ground wire 14 therewith. Such snug friction fit is achieved by the tapering of the overall width of chambers 34 and 38. With reference to FIGS. 2 and 4, it may be observed that sleeve 16 deforms slightly such that wall portions 52 and 54 have been straightened, FIGS. 2 and 4. In addition, with reference to FIG. 5, it may be apparent that ground wire 14 has also been slightly deformed at points 56 and 58, which mark the extent of contact with ground rod 12. Again, such deformation of ground wire 14 is due to the fact that ground wire 14 is typically constructed of a material that is softer than ground rod 12, heretofore described. The resultant interconnection between ground rod 12 and ground wire 14 is extremely tight and durable.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device for connecting a ground rod to an electrical conductor comprising:

a. a unitary sleeve having a first open chamber for accommodating the ground rod, and a second open chamber for accommodating an electrical conductor, said first and second open chambers each including a mouth, said mouth of said first open chamber facing said mouth of said second open chamber, said unitary sleeve further including an edge portion having an impact surface said sleeve being constructed of a material possessing greater flexibility than the ground rod and electrical conductor;

b. contacting means for urging the ground rod into engagement with the electrical conductor upon the application of a force to said impact surface of said unitary sleeve, said contacting means comprising said first and second open chambers each including a transverse dimension and a dimension extending orthogonally relative to said transverse dimension, the sum of said transverse dimensions of said first and second open chambers tapering along said dimension extending orthogonally relative to said transverse dimension.

2. The device of claim 1 in which said sleeve is constructed of a material possessing a greater malleability than the ground rod and electrical conductor.

3. The device of claim 1 in which said sleeve is deformable upon the application of said connecting means.

4. The device of claim 1 in which additionally comprises a sheath at least partially extending over said sleeve, said sheath further including fastening means for hold said sheath to said sleeve.

5. The device of claim 4 in which sad sheath further comprises a connector for a conduit capable of enclosing the electrical conductor.

* * * * *